United States Patent [19]

King

[11] Patent Number: 4,952,309

[45] Date of Patent: Aug. 28, 1990

[54] AUGER-TYPE FLOUR SIFTER

[75] Inventor: Donald E. King, Louisville, Ky.

[73] Assignee: AyrKing Corporation, Louisville, Ky.

[21] Appl. No.: 206,354

[22] Filed: Jun. 14, 1988

[51] Int. Cl.[5] ..... B07B 1/46; B07B 1/52

[52] U.S. Cl. ..... 209/235; 209/257; 209/261; 209/281; 209/370; 209/390

[58] Field of Search ..... 209/283, 390, 386, 235, 209/244, 257, 259, 274, 281, 300, 370, 373, 374, 375, 409, 261; 118/603, 610, 26, 31, 29, 16, 17, 19, 22

[56] References Cited

U.S. PATENT DOCUMENTS

| | | | |
|---|---|---|---|
| 397,760 | 2/1889 | Tangenberg | 209/283 |
| 686,593 | 11/1901 | Currier | 209/216 |
| 888,827 | 5/1908 | Laverty | 209/283 |
| 891,424 | 6/1908 | Jessup | 209/283 |
| 1,191,280 | 7/1916 | Clawson | 209/269 |
| 1,204,261 | 11/1916 | Erfurth | 209/247 |
| 1,353,545 | 9/1920 | Sturtevant | 209/347 |
| 1,430,443 | 9/1922 | Griffoul | 209/283 |
| 3,129,167 | 4/1964 | Frangos | 209/370 X |
| 3,280,973 | 10/1966 | Cartwright et al. | 209/233 |
| 3,313,414 | 4/1967 | Cox | 209/373 X |
| 3,394,808 | 7/1968 | Thompson | 209/245 |
| 3,520,277 | 7/1970 | Gordon | 118/26 X |
| 3,865,727 | 2/1975 | Broling et al. | 209/283 X |
| 4,124,498 | 11/1978 | Russell | 209/267 |
| 4,126,541 | 11/1978 | Orzechowski | 209/240 |
| 4,155,843 | 5/1979 | Christianson | 209/616 |
| 4,458,586 | 7/1984 | Reed | 118/22 X |
| 4,496,086 | 1/1985 | Duchadeau | 222/412 |
| 4,550,677 | 11/1985 | Reese et al. | 209/234 X |

FOREIGN PATENT DOCUMENTS

| | | | |
|---|---|---|---|
| 281 | of 1881 | United Kingdom | 209/386 |
| 28199 | of 1910 | United Kingdom | 209/283 |

*Primary Examiner*—Donald T. Hajec

*Attorney, Agent, or Firm*—Woodard, Emhardt, Naughton, Moriarty & McNett

[57] ABSTRACT

A flour sifter for separating doughballs from fine particulate matter in a breading mixture, comprises a hopper for receiving the breading mixture. The lower portion of the hopper includes a sifting screen along most of the longitudinal length that is sized to allow only the fine particulate matter to pass therethrough. The hopper may be an insert for a sifter table that is readily removably mounted within a flour sifter enclosure. The hopper insert is mounted to accommodate a breading lug above the insert. A slot at one end of the hopper is large enough for the doughballs to pass therethrough. The enclosure is provided with mounting flanges to support another breading lug below the hopper insert to receive the sifted fine particulate matter. A doughball ejector chute is associated with the slot of the hopper insert to direct the doughballs from the hopper insert to a doughball collector pan. The hopper further includes an auger brush having a helical pattern of bristles along the length of the brush. The auger brush is readily removably rotationally mounted within the hopper such that said ends of the bristles rotate at least adjacent to the sifting screen. A motor and coupling mechanism rotate the auger brush within the hopper, so that as the auger brush rotates, the helical pattern of bristles urges the doughballs toward the slot in the lower portion, while the fine particulate matter of the breading mixture falls through the sifting screen.

14 Claims, 4 Drawing Sheets

AUGER-TYPE FLOUR SIFTER

BACKGROUND OF THE INVENTION

The present invention relates to a sifter for sifting materials such as flour.

In the food services industry, a variety of foods are breaded prior to baking or frying. For instance, in fried chicken franchises, the chicken pieces are dipped in a liquid batter and then rolled in powdered breading that adheres to the surface of the chicken pieces. The powdered breading, such as a flour mixture, is contained in a breading lug in sufficient quantity to allow several pieces of chicken to be breaded before the breading lug is removed and replaced with a new lug filled with a fresh flour mixture.

In order to reduce waste, and to improve the cost efficiency of breading baked or fried foods, it is common to sift the flour from the used breading lug to separate the reusable flour from the unusable doughballs that are formed as batter and blood drip into the breading lug.

In the prior art, the flour sifter has been of a vibratory or oscillatory type. One such device is illustrated in the patent to Russell, U.S. Pat. No. 4,124,498, in which a perforated semi-cylindrical sifter is rotationally oscillated so that the reusable flour falls through the perforations in the sifter into a collector bin, while the unusable doughballs are gradually directed to an opening in the end of the sifter. The vibratory equipment of the prior art is noisy and subject to the problems typical of vibrating equipment. Another problem experienced by these prior art devices arises when a breading mixture is used that includes a variety of powdered or granular compounds, such as salt and other spices. The vibratory sifters have a tendency to cause the less dense compounds to fall through the perforations in the sifter first, followed by the more dense compounds, thereby separating the breading mixture.

In view of the restrictions and problems encountered by the sifters of the prior art, it is one object of the present invention to provide a sifter for separating the usable breading mixture from the unusable doughballs. It is another object to provide a sifter that is quiet in operation and less susceptible to break-down than the vibratory devices of the prior art. Yet another object is to provide a sifter that will sift the breading mixture in a consistent and uniform manner, without separating the constituent components of the breading mixture. Further objects and benefits of the present invention will be apparent from the following description and accompanying figures.

SUMMARY OF THE INVENTION

A flour sifter for separating doughballs from fine particulate matter in a breading mixture, comprises a hopper for receiving the breading mixture having a generally semi cylindrical lower portion along a first longitudinal length. The lower portion includes a sifting screen along most of the longitudinal length that has a plurality of openings sized to allow only the fine particulate matter to pass therethrough. The lower portion also includes a slot at one end of the lower portion that is large enough for the doughballs to pass therethrough. The hopper further includes an auger brush having a helical pattern of bristles along the longitudinal axis of the brush, each of the bristles having an end extending generally radially from the brush longitudinal axis. The auger brush is removably rotationally mounted within the hopper such that said ends of the bristles rotate at least adjacent to the sifting screen. The flour sifter includes a motor and coupling mechanism for rotating the auger brush within the hopper, so that as the auger brush rotates, the helical pattern of bristles urges the doughballs toward the slot in the lower portion, while the fine particulate matter of the breading mixture falls through the sifting screen.

DESCRIPTION OF THE PREFERRED EMBODIMENT

Figure 1:
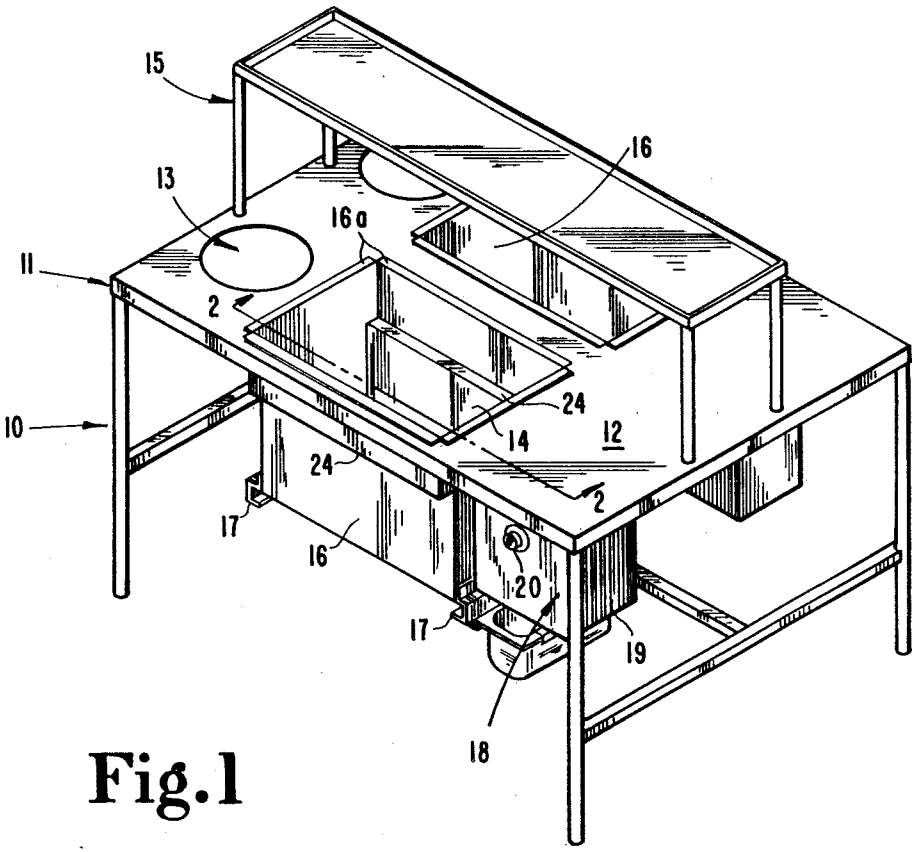
FIG. 1 is perspective view of a double sifter of the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In the preferred embodiment of the present invention, a double sifter 10 includes a table 11, such as the stainless steel table typically used in the food services industry. The table 11 includes a top surface 12, having a pair of dip bucket openings 13 situated in opposite halves of the table. In the use of the double sifter 10, a dip bucket, not shown in the figures, is placed in the opening 13 and supported by the top surface 12 of the table 11. The dip bucket is typically used to hold the liquid batter into which the food item is dipped prior to breading.

The top surface 12 also includes a pair of lug openings 14, also situated in opposite halves of the table 11. A flour sifter enclosure 16 is situated in the lug opening 14, and held in position by flanges **16*a* around the perimeter of the flour sifter enclosure 16. The flanges 16*a* are bent at right angles to the sidewalls of the flour sifter enclosure and are mounted flush against the top surface 12 of the table. The flanges 16*a* can be welded or affixed in some other suitable manner to the top surface 12 to hold the flour sifter enclosure 16** in place.

The table 11 includes an overhead shelf 15 mounted by legs to the top surface 12. The overhead shelf can be used to temporarily store the food item to be breaded. The overhead shelf 15 may also include a drain and a drip bucket, not shown, to receive any grease or blood that may drip on the overhead shelf.

Figure 2:
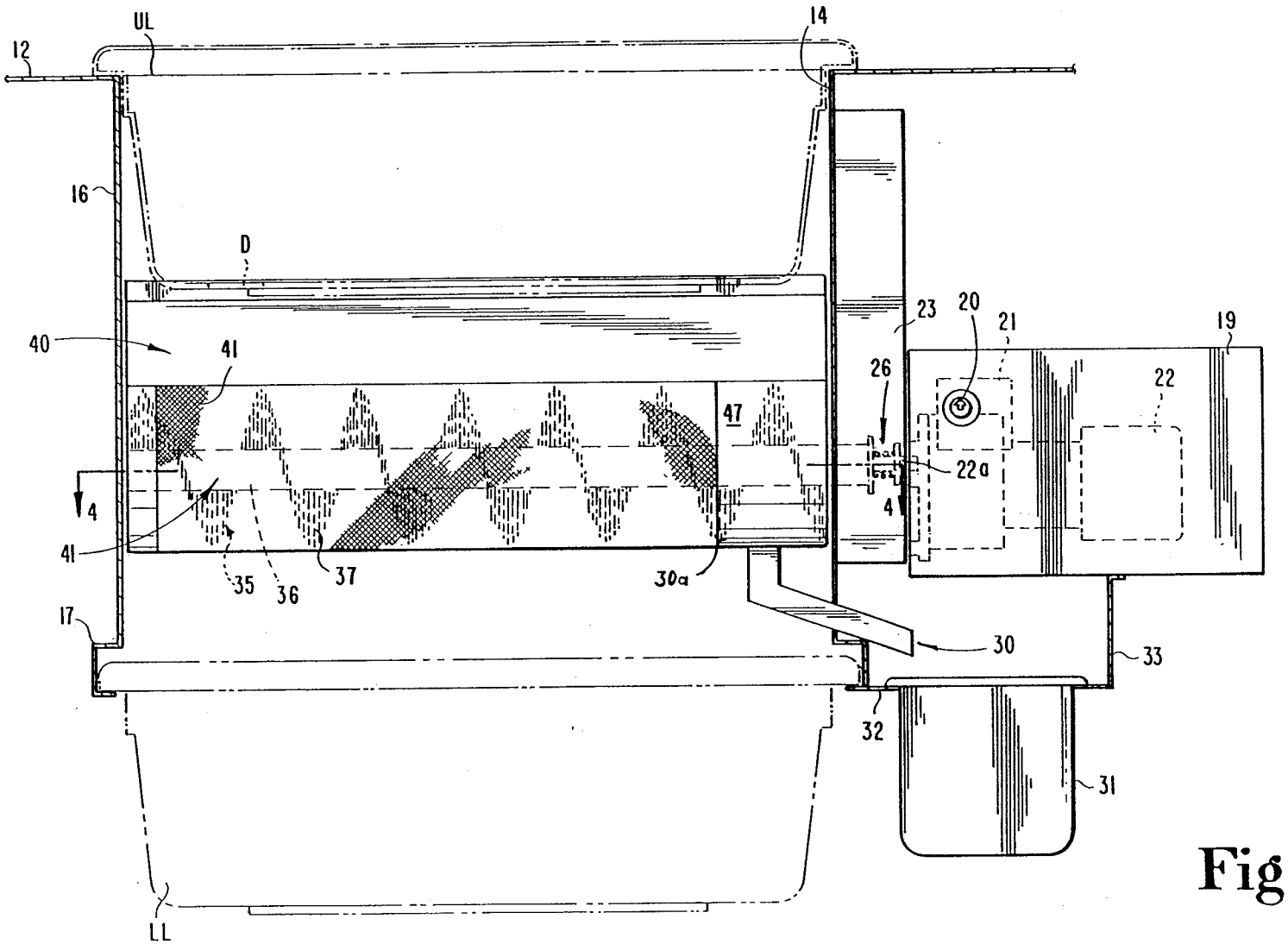
FIG. 2 is a side cross sectional view of the flour sifter of the present invention, as installed in the double thick sifter illustrated in FIG. 1, taken along the line 2—2 in FIG. 1 as viewed in the direction of the arrows.

At the bottom side edges of the flour sifter enclosure 16, are a pair of lower lug brackets 17. The lower lug brackets 17 are channel shaped to receive the rim of a standard breading lug, such as breading lug LL shown in FIG. 2. Also as shown in FIG. 2, an upper lug UL is placed in the lug opening 14 through the top surface 12 of the table. The rim of the upper lug UL rests upon the top surface 12 while the double sifter 10 is in use. The lug opening 14 and the lower lug bracket 17 are adapted so that a breading lug can be easily inserted and removed. In the use of the double sifter 10, the upper breading lug UL will contain the breading mixture into which the food, such as chicken pieces, is rolled during breading. The lower lug LL, when mounted in the lower lug bracket 17, will receive the reusable flour that passes through the flour sifter of the present invention as described herein.

As shown in FIG. 1, the flour sifter enclosure 16 includes a positioning ledge 24 at opposite sides of the flour sifter enclosure. In the preferred embodiment, the positioning ledge 24 is formed by a reduced width portion of the flour sifter enclosure 16, that is with portions of the front and back walls of the enclosure slightly inset. The positioning ledge 24 is sufficiently far below the top surface 12 so that a standard breading lug, such as lug UL, can fit into the lug opening 14 without contacting the positioning ledge 24.

A motor and timing assembly 18 is mounted to the side of the flour sifter enclosure 16, as shown in FIGS. 1 and 2. The motor and timing assembly 18 includes a motor and timer enclosure 19 that is affixed to a motor mounting channel 23, which is itself affixed to the flour sifter enclosure 16. Each of the motor and timer enclosure 19, motor mounting channel 23, and flour sifter enclosure 16 can be formed of stainless steel and can be connected by welding or other suitable means. The motor and timer assembly 18 includes a motor 22 and a timer 21, for timing the length of operation of the motor, and consequently, the length of the sifting time. The timer 21 includes a timer set knob 20 that projects to the outside of the motor and timer enclosure 19.

Referring to FIG. 2, the double sifter 10 is shown as including a hopper insert 40, which is the heart of the present invention. The hopper insert 40 is placed within the flour sifter enclosure 16 and rests upon the positioning ledges 24 of the enclosure 16. The hopper insert 40 includes first separating means having a sifting screen 41 that spans most of the length of the insert 40. The sifting screen 41 includes a plurality of perforations sized to allow the reusable portion of the breading mixture to fall through the screen. The hopper insert 40 also includes an auger brush assembly 35 that rotates within the insert. The auger brush assembly 35 includes an auger shaft 36 that is mounted for rotation within the hopper insert 40. The auger shaft 36 is connected to the drive shaft **22*a* of the motor 22 by a coupling assembly 26**.

A second separating means having doughball ejector chute 30, which is associated with the flour sifter enclosure 16, as shown in FIG. 2, so that the entrance to the chute 30 is situated beneath an opening in the hopper insert 40 (not shown in FIG. 2). The doughball ejector chute 30 may be in the form of a hollow tube or in the form of an open ended channel. The outlet of the doughball ejector chute 30 is directed toward a doughball collector pan 31, so that unusable doughballs isolated by the hopper insert 40 of the present invention, fall into the collector pan 31 for subsequent disposal. The rim of the collector pan 31 is supported by flange 32 extending from the lower lug bracket 17 on one side, and on the other side by another flange 33 affixed to the motor and timer enclosure 19. The ejector chute 30 can be of stainless steel construction. It may be welded to the hopper insert 40, or it may include a flange at its entrance to engage the opening in the insert. In the latter case, the chute can be removed for cleaning.

Figure 3:
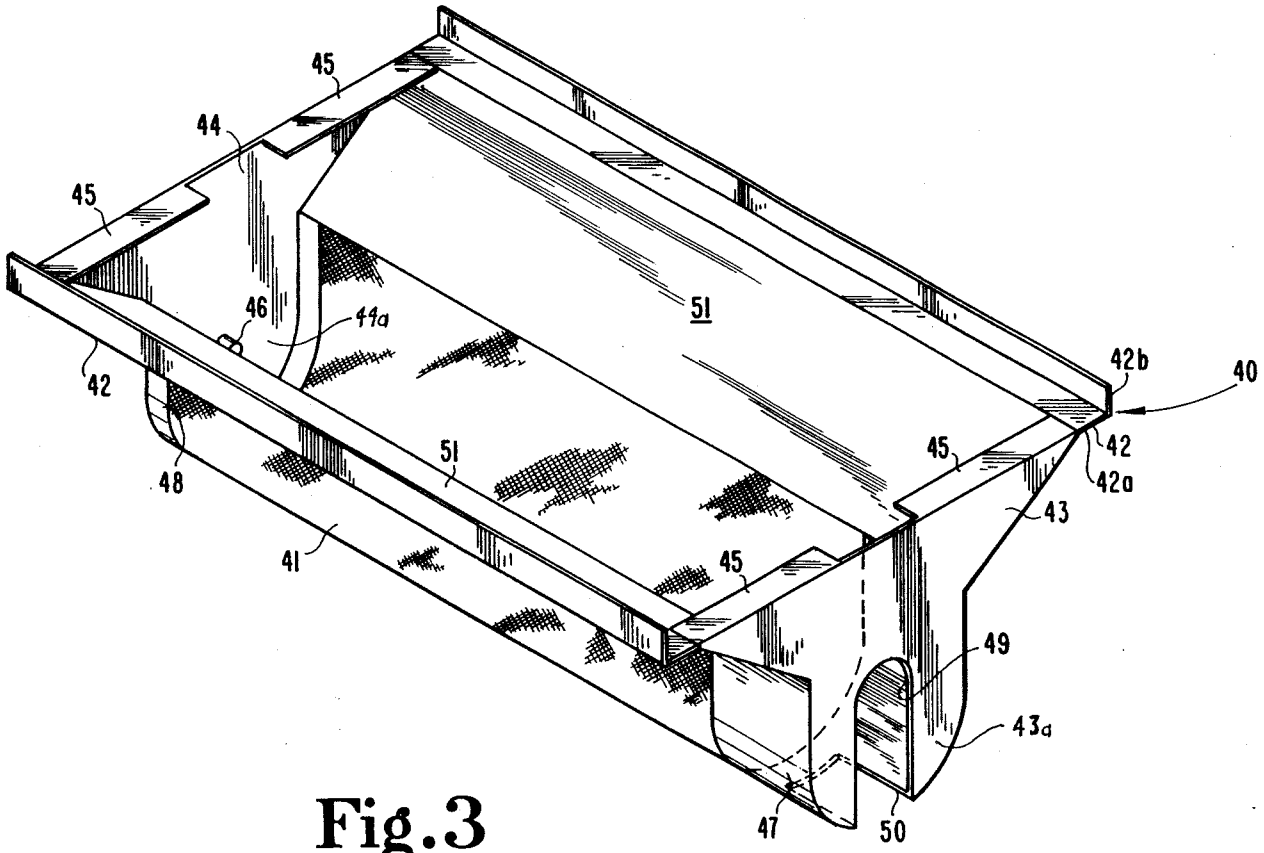
FIG. 3 is an enlarged perspective view of the hopper insert of the present invention.

The details of the hopper insert 40 are illustrated with reference to FIG. 3. The insert 40 is preferably of thin-walled sheet metal construction, as is the table 11 and the flour sifter enclosure 16 previously described. The hopper insert 40 includes a positioning flange 42 that extends along the length of opposite sides of the insert, as shown in FIG. 3. The positioning flanges 42 are preferably right angle sections, with a horizontal portion **42*a* that rests upon the positioning ledge 24, and a vertical portion 42*b* that fits flush against the vertical wall of the flour sifter enclosure 16. Extending from each positioning flange are a pair of sidewalls 51 that are oriented at an angle relative to the positioning flanges. The angle of these sidewalls 51 insures that the flour mixture poured into the hopper insert 40** will fall naturally toward the center and bottom of the insert.

Affixed to the positioning flanges 42 and sidewalls 51 are a pair of end plates, 43 and 44. The motor end plate 43 is situated adjacent the motor and timer assembly 18 when the hopper insert 40 is in position inside the flour sifter enclosure 16. The alignment end plate 44 is opposite the motor end plate 43. Each of these end plates 43 and 44 have an upper triangular portion to correspond to the angled sidewalls 51, and a lower semi-circular portion, such as portion **43*a* of motor end plate 43**.

In the preferred embodiment, a forward plate 47 is integral with the side walls 51 over a portion of the plate 47, transitioning into a semi-circular shape along the bottom of the hopper insert 40 corresponding to the semi-circular shape of the lower portions **43*a* of motor end plate 43. Likewise, a rear plate 48 follows side walls 51 and the semi circular lower portion 44*a* of alignment end plate 44. In the preferred embodiment, the forward plate 47 is approximately 4 inches long, while the rear plate 48 is approximately ½ inch long, as measured along the longitudinal length of the hopper insert 40. Attached between the forward plate 47 and the rear plate 48 is the flour sifter screen 41. The screen is wrapped in the same semi circular shape to form a partial cylinder, and is affixed at its upper edges to each of the sidewalls 51, as illustrated in FIG. 3. As mentioned previously, the sifter screen 41** includes openings large enough for the reusable breading mixture to pass through, but not large enough to accept doughballs.

The motor end plate 43 includes an elongated vertical notch 49 in the semi-circular portion **43*a*. The notch 49 corresponds to a doughball ejection slot 50 along the bottom of the insert 40 in the forward plate 47. The alignment end plate 44 includes an alignment knob 46 that is generally centrally located in the lower semi-circular portion 44*a* of the alignment end plate. The upper edges of the motor end plate 43 and alignment end plate 44 include a pair of spaced apart removal handles 45. These removal handles 45 are provided so that the user can grasp the handles to pull the hopper insert 40 from the flour sifter enclosure 16. The handles are spaced apart leaving a gap therebetween to allow the auger brush assembly 35 (as shown in FIG. 2) to be inserted and removed from the hopper insert 40**.

Figure 4:
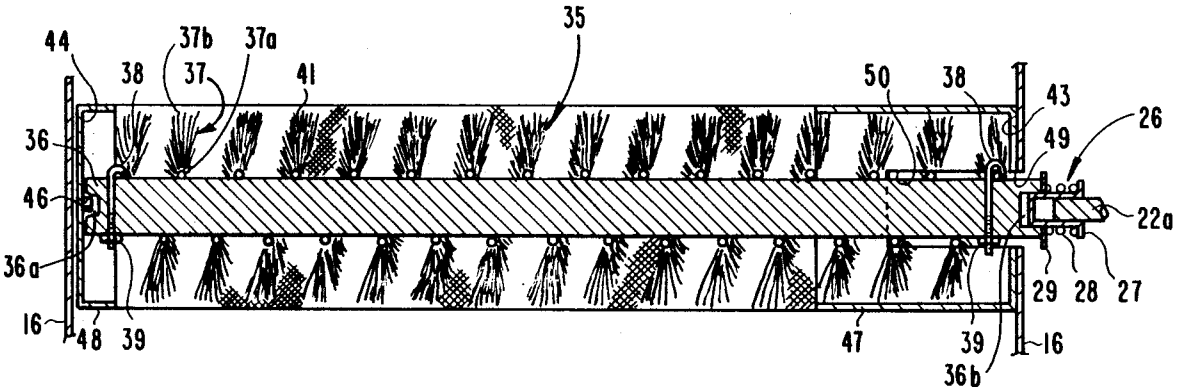
FIG. 4 is an enlarged sectional view of the hopper insert of the present invention, as illustrated in FIG. 2 and as taken along the line 4—4 and viewed in the direction of the arrows.

The details of the auger brush assembly 35 are illustrated with reference to FIG. 4. The auger brush assembly 35 includes an auger shaft 36 that, in the preferred embodiment, has a length slightly longer than the longitudinal length of the hopper insert 40. An alignment recess 36a is formed at one end of the auger shaft 36. The alignment recess 36a is adapted to receive the alignment knob 46 therein when the auger brush assembly 35 is in place in the hopper insert 40. At the opposite end of the auger shaft 36 is a mating recess 36b. The mating recess is adapted to engage the coupling assembly 26 that rotationally connects the auger brush assembly 35 with the motor drive shaft 22a.

The coupling assembly 26 includes a washer 29 that abuts the end of the auger shaft 36, a mating cap 27 that is engaged in the mating recess 36b of the auger shaft 36, and a spring 28 situated between the washer 29 and the mating cap 27. The spring 28 is provided to absorb any axial motion between the auger shaft 36 and the mating cap 27. The motor drive shaft 22a is splined or press fit into the mating cap 27. The mating cap 27 is, itself, splined or press-fit into the mating recess 36b so that rotation from the motor 22 is transmitted directly to rotation of the auger shaft 36. In another version, the mating cap 27 is slip-fit into the mating recess 36b. The spring 28 has sufficient axial stiffness to press against washer 29 to form a friction drive of the shaft 36.

When the auger brush assembly 35 is installed in the hopper insert 40, the mating end of the auger shaft 36, that is the end having mating recess 36b, is inserted into the hopper insert 40 and through the notch 49 in the motor end plate 43. Then, the remaining portion of the auger shaft 36 is placed into the insert 40, and the alignment recess 36a in the auger shaft 36 is mounted over the alignment knob 46 in the alignment end plate 44. The auger brush assembly 35 is preferably installed into the hopper insert 40 when the insert itself is in position within the flour sifter enclosure 16. Thus, it is possible to install the auger brush assembly 35 while also mating the auger shaft 36 with the motor drive shaft 22a.

The auger brush assembly 35 includes a bristle array 37 that is wrapped around the auger shaft 36. In the preferred embodiment, the bristle array 37 is a helical, or coiled, structure of bristles. The bristle array includes a spiral rib 37a coiled around the auger shaft 36. The bristles 37b are mounted or connected to the spiral rib 37a. The spiral rib 37a is retained at each end on the auger shaft 36 by a pair of J-pins 38. At each end of the auger shaft 36, the J-pin 38 is fed through a bore in the shaft and held in place on the opposite side of the shaft by a nut 39. When the nut 39 is tightened, the J-pin 38 tightens around the end of the spiral rib to hold the bristle array 37 in place about the auger shaft 36.

The hopper insert 40 and the auger brush assembly 35 provide a novel apparatus adapted to sift a powdered mixture, such as doughballs, to remove large particles from fine particulate matter, such as a flour breading mixture. In the preferred manner of using the present invention the hopper insert 40 is placed within the flour sifter enclosure 16, with the positioning flanges 42 resting upon the positioning ledges 24. Once the hopper insert 40 is in position, the doughball ejector chute 30 can be inserted through the doughball ejection slot 50 in the forward plate 47 of the insert. The doughball ejector chute 30 may have a top peripheral flange 30a about the chute that rests against the forward plate 47 to retain the doughball ejector chute 30 within the doughball ejection slot 50. The doughball collector pan 31 is positioned on pan mounting flanges 32 and 33 directly beneath the outlet of the doughball ejector chute 30.

Once the hopper insert 40 is in position, the auger brush assembly 35 may be installed within the insert as previously described. The mating end of the auger shaft 36 is mated with the coupling assembly 26 to rotationally connect the auger shaft with the drive motor. In the Preferred embodiment, the bristles 37b extend outwardly from the auger shaft 36 sufficiently far so that the ends of the bristles will contact the sifting screen 41. The ends of the bristles may be set away from the screen, provided that they are sufficiently close that doughballs cannot pass between the bristles and the screen.

Once the auger brush assembly 35 is in position, the upper and lower breading lugs, UL and LL, can be mounted through the top lug opening 14 and the lower lug bracket 17, respectively. When the double sifter 10 is used in its preferred commercial setting, a breading mixture is poured into the upper breading lug UL. The food to be breaded, such as chicken pieces, is dipped into the breading lug so that the powdered breading will adhere to the surface of the chicken parts. After a certain period of use, the breading mixture in the upper breading lug UL becomes mixed with blood and fat and other fluids so that the breading operation becomes less efficient. In this case, then, the used breading mixture may be directed through the opening D in the upper breading lug UL, or the used breading mixture may be poured directly into the hopper insert 40, filling the hopper insert.

The breading mixture that has not been combined with blood, grease or other fluids to form doughballs will then fall directly through the openings in the flour sifting screen 41. However, doughballs that were formed from the mixture of the flour and the blood or grease, will not fall through the flour sifter screen. In this instance, the auger brush assembly 35 is rotated in a direction so as to gradually direct the doughballs toward the doughball ejection slot 50 and, ultimately, to the doughball ejector chute 30. As the auger brush assembly 35 is rotated, the bristles 37b are, essentially, pressed against the screen 41, and any doughballs resting against the screen are pushed along by the helical pattern of bristles. In addition, the rotation of the auger brush assembly 35 acts to distribute the fine particulate portion of the breading mixture along the screen, thereby allowing the uncontaminated mixture to fall through the openings around the entire width of the flour sifting screen 41. The uncontaminated flour can be pressed through the screen 41 by the bristles 37b at any location along the screen.

The timer set knob 21 is used to set the timer, which in turn times the operation of the motor 22, and thereby the rotation of the auger brush assembly 35. Thus, the hopper insert and auger brush assembly can be set automatically to sift the flour mixture for a given period of time, after which all of the doughballs in the mixture have been ejected into the doughball collector pan 31, and all of the uncontaminated flour mixture has fallen through the sifting screen 41 into the lower breading lug LL.

Once the sifting operation is complete, the upper breading lug UL can be removed and swapped with the lower breading lug LL. The newly sifted flour mixture then can be used to coat new food articles. One of the important benefits of the auger brush assembly and sifting screen features of the present invention is that the sifting operation does not isolate or separate the comPonents of the flour mixture, such as salt, herbs, or other substances. Thus, the flour mixture passing through the sifting screen 41 is a complete mixture and ready for use in breading new food items.

Before the lower breading lug LL is moved to the lug opening 14, the entire hopper insert 40 can be removed for cleaning. Likewise, the auger brush assembly 35 and the doughball ejector chute 30 can be removed for separate cleaning, and then reinstalled. The hopper insert and its components can be made of stainless steel for ease of cleaning and to maintain a sanitary work area. Thus, it is apparent that the hopper insert 40 and the auger brush assembly 35 of the present invention represents an extremely versatile and useful improvement on the flour sifting devices of the prior art.

Since the double sifter 10 of the present invention uses an auger brush assembly and rotational motion, rather than a vibratory motion, the sifter of the present invention is much quieter than the prior art sifters. Moreover, a direct rotational coupling can be made between the motor and the sifting mechanism—that is, the auger brush assembly—unlike the apparatus of the prior art in which a complicated coupling is required to translate the motor rotational motion to a pitching or rocking vibrational motion of the sifting mechanism. Since the components of the sifter 10 of the present invention, namely the motor 22 and auger brush assembly 35, operate in one direction only, that is, rotational, the amount of wear experience by the components of the present sifter is much less than that experienced by devices of the Prior art.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A flour sifting apparatus for separating doughballs from fine particulate matter in a breading mixture, comprising:

a hopper for receiving said breading mixture, said hopper including a generally semi-cylindrical lower portion having a first longitudinal axis, said lower portion further including a sifting screen along said first longitudinal length, said sifting screen having a plurality of openings sized to allow only said fine particulate matter to pass therethrough, said lower portion also including a slot at one end of said lower portion, said slot being large enough for said doughballs to pass therethrough;

an auger brush having a second longitudinal axis and including a helical pattern of bristles along said second longitudinal axis, each of said bristles having an end extending generally radially from said longitudinal axis;

means for readily removably rotationally mounting said auger brush within said hopper with said second longitudinal axis generally parallel to said first longitudinal axis, such that said ends of said bristles rotate at least adjacent to said sifting screen; and means for rotating said auger brush within said hopper, whereby as said auger brush rotates, said helical pattern of bristles urges said doughballs toward said slot in said lower portion, while said fine particulate matter passes through said sifting screen, wherein said auger brush includes;

a spiral rib having a central longitudinal opening;

means for affixing said bristles to said spiral rib;

a longitudinal shaft passing through said central opening of said spiral rib; and means for readily removably engaging said spiral rib about said longitudinal shaft including;

a pin having a hook for engaging said spiral rib and a shaft which is fed through a bore in said shaft;

a nut which is fastened to an end of said shaft of said pin.

2. The sifting apparatus of claim 1, wherein:

said hopper includes a pair of opposite end walls; and said means for rotating includes;

an alignment knob projecting inward from a first one of said end walls; and an alignment bore in one end of said longitudinal shaft for rotationally receiving said alignment knob therein when said auger brush is mounted in said hopper.

3. The sifting apparatus of claim 2, wherein:

each of said pair of opposite end walls include an upper edge, each said upper edge including a hand grip having an inwardly directed flange over a portion of said upper edge.

4. A sifter table comprising:

a table having a top surface with a lug opening therethrough;

a flour sifter enclosure mounted to said table beneath said lug opening;

means for separating doughballs from fine particulate matter in a breading mixture including a hopper insert sized to be received through said lug opening, having a first longitudinal length, said hopper insert including;

a semi-cylindrical lower portion having a screen extending along said first longitudinal length of said lower portion, said screen having a plurality of openings sized to allow only said fine particulate matter to pass therethrough; and a slot at one end of said lower portion sized to receive said doughballs therethrough;

means for readily removably mounting said hopper insert within said flour sifter enclosure to permit slidable removal of said hopper insert through said lug opening;

an auger brush including a shaft having a second longitudinal length, and a helical pattern of bristles along the longitudinal length of said shaft, each of said bristles having an end extending generally radially from said shaft;

means for readily removably rotationally mounting said auger brush within said hopper insert such that said ends of said bristles rotate at least adjacent to said sifting screen; and means for rotating said auger brush within said hopper insert, whereby as said auger brush rotates, said helical pattern of bristles urges said doughballs toward said slot in said lower portion.

5. The sifter table of claim 4, wherein:

said means for removably rotationally mounting said auger brush includes;

said hopper insert having a pair of opposite end walls, a first end wall having an alignment knob projecting therefrom and a second end wall having a notch therethrough; and said shaft includes an alignment recess at a first end of said shaft corresponding to said alignment knob, whereby said alignment knob is removably received within said alignment recess when said auger brush is mounted within said hopper; and means for removably coupling a second end of said shaft with said means for rotating, said coupling means extending through said notch in said second end wall.

6. The sifter table of claim 4, wherein:

said means for readily removably mounting said hopper insert includes means for mounting said insert such that a first breading lug is removably mountable within said lug opening above said insert.

7. The sifter table of claim 6, wherein:

said flour sifter enclosure includes a pair of opposite edges parallel to said first longitudinal length; and said hopper insert includes a pair of opposite flanges corresponding to said pair of opposite edges, whereby said pair of flanges rest on said pair of edges when said hopper insert is mounted within said flour sifter enclosure.

8. The sifter table of claim 7, wherein:

each of said opposite end walls of said hopper insert includes an upper edge and hand grip means at said upper edge including an inwardly directed flange over a portion of said upper edge.

9. The sifter table of claim 6, further comprising:

means, associated with said flour sifter enclosure, for removably mounting a second breading lug beneath said hopper insert for receiving said fine particulate matter;

wherein, said first and said second breading lug are interchangeable.

10. The sifter table of claim 4, further comprising:

a doughball collector pan removably associated with said sifter table., a collector chute; and means for removably mounting said collector chute within said slot in said lower portion so that doughballs passing through said slot are directed by said collector chute into said doughball collector pan.

11. The sifter table of claim 4, wherein:

said means for rotating includes;

an electric motor having a rotary drive shaft;

means for removably rotationally coupling said drive shaft to said auger brush.

12. The sifter table of claim 11, wherein:

said means for rotating further includes a timer mechanism for limiting the time of operation of said electric motor.

13. The sifter table of claim 11, wherein:

the auger brush shaft includes a mating recess positioned at an end thereof;

said means for coupling includes a mating cap which fixedly engages said mating recess and said drive shaft to directly transmit rotation from said drive shaft to the auger brush shaft.

14. The sifter table of claim 11, wherein:

the auger brush shaft includes a mating recess positioned at an end thereof;

said means for coupling includes;

a mating cap which is rotationally mountable in said mating recess and fixedly engaged to said drive shaft;

a washer which abuts said end of the auger brush shaft;

a spring which is interposed between said washer and said mating cap to form a friction drive for the auger brush shaft.

* * * * *